US006823797B2

(12) United States Patent
Duguet et al.

(10) Patent No.: US 6,823,797 B2
(45) Date of Patent: Nov. 30, 2004

(54) PROCESS FOR THE PREPARATION OF AN ELECTROPYROTECHNIC INITIATOR BY USE OF AN AQUEOUS ADHESIVE

(75) Inventors: Jean-René Duguet, Survilliers (FR); Jérôme Pillaert, Senlis (FR)

(73) Assignee: Livbag SNC, Paris (FR)

( * ) Notice: Subject to any disclaimer, the term of this patent is extended or adjusted under 35 U.S.C. 154(b) by 0 days.

(21) Appl. No.: 10/301,567

(22) Filed: Nov. 22, 2002

(65) Prior Publication Data

US 2003/0110971 A1 Jun. 19, 2003

(30) Foreign Application Priority Data

Dec. 14, 2001 (FR) ..... 01 16218

(51) Int. Cl.[7] ..... F42B 3/10

(52) U.S. Cl. ..... 102/202.5; 102/202.7; 102/202.14

(58) Field of Search ..... 102/202.5, 202.7, 102/202.14; 86/1.1

(56) References Cited

U.S. PATENT DOCUMENTS

| | | | | |
|---|---|---|---|---|
| 4,016,018 A | | 4/1977 | Lenotre | |
| 5,544,585 A | | 8/1996 | Duguet | |
| 5,939,660 A | * | 8/1999 | Fogle, Jr. | 102/202.7 |
| 6,272,992 B1 | | 8/2001 | Chatley, Jr. | |
| 6,289,813 B1 | | 9/2001 | Duguet et al. | |

FOREIGN PATENT DOCUMENTS

| | | |
|---|---|---|
| EP | 1 030 159 A1 | 8/2000 |
| FR | 2 720 494 A1 | 12/1995 |
| FR | 2 781 878 A1 | 2/2000 |
| WO | WO 95/11421 | 4/1995 |
| WO | WO 98/45663 | 10/1998 |

* cited by examiner

*Primary Examiner*—Aileen Felton
(74) *Attorney, Agent, or Firm*—Oliff & Berridge, PLC

(57) ABSTRACT

An electropyrotechnic initiator comprising a pyrotechnic varnish in contact with a resistive heating element is prepared by preparing an aqueous adhesive composed of a dispersion of an explosive substance and of additives in an aqueous suspension based on a copolymer chosen from ethylene/vinyl acetate copolymers and vinyl acetate/ethylene acetate/ethylene copolymers, depositing the aqueous adhesive on the resistive element, and drying the aqueous adhesive at a temperature of between 55° C. and 75° C., in order to remove the water contained in the adhesive and to obtain the varnish.

25 Claims, 2 Drawing Sheets

PROCESS FOR THE PREPARATION OF AN ELECTROPYROTECHNIC INITIATOR BY USE OF AN AQUEOUS ADHESIVE

The present invention relates to the technical field of electropyrotechnic initiators. More specifically, the invention relates to a process for the preparation of an electropyrotechnic initiator. This manufacturing process is suitable for any type of initiator. They are either detonating initiators, also known as detonators, or ignition-type initiators, intended for the ignition of propellant powder or of gas-generating substances. In the latter case, the most widespread application is that of the igniters for safety devices intended to protect the occupants of a motor vehicle.

An electropyrotechnic initiator is composed of a resistive heating element and of a heat-sensitive substance. The resistive element can exist in the form of a filament, of a small and very thin flat element deposited on a printed circuit support or of a resistive or semiconductor bridge made of thin layers.

When an electric current circulates in the resistive element, the latter is heated by the Joule effect and, for this reason, ignites the heat-sensitive substance. The latter must therefore be in close contact with the resistive element in order to provide for reliable transfer of heat between the resistive element and the heat-sensitive substance. This is generally obtained by exerting on the said substance, in the pulverulent state, a significant compressive force directed towards the resistive element and thus providing intimate contact and the maintenance thereof. Such a compressive process has disadvantages. This is because, in order to be capable of withstanding such a compressive force without being deformed, the structure of the initiator has to comprise very strong components, such as a compression ring, for example. Furthermore, the process for assembling the initiator requires the use of significant means for metering out and compressing the pulverulent substance. A distribution hopper and a hydraulic press are generally used. Such a process is generally carried out under a pressure of the order of 1 000 bar. Such a process, often employed in industry, thus requires significant means for protecting personnel against the risks inherent in the use and compression of dry explosive materials. Furthermore, during compression, the resistive element may be damaged.

In order to overcome the disadvantages of the compression techniques, described above, and to provide close contact of the pyrotechnic substance with the resistive element in a way which is stable and fixed over time, a person skilled in the art then attempted to "adhesively bond" the heat-sensitive substance to the resistive element. The heat-sensitive substance is then deposited in the form of a compact paint which adheres to the support.

A first method of preparation is to use solvents. Patent FR 2 704 944 and its corresponding U.S. Pat. No. 5,544,585 disclose such an embodiment. The explosive varnish disclosed in this patent is composed of a primary explosive or a heat-sensitive oxidizer-reducer mixture with the addition of 2 to 15% of film-forming binder, dissolved beforehand in a solvent. The varnish is deposited on the resistive element and the solvent is evaporated.

Another known preparation is that disclosed in Patent Application FR 2 794 235, filed under priority U.S. Pat. No. 0,927,5555. The explosive varnish comprises a pyrotechnic material in the form of particles and a binder composed of a particulate polymer resin. The varnish can additionally comprise a solvent, ethyl alcohol. The varnish is first of all deposited on the resistive element and then heated to a first temperature, of the order of 100° C., to drive off the solvent, and then to a second temperature, of the order of 150° C., to agglomerate the particles of the binder to one another and to bind the varnish to the resistive element.

There are disadvantages to these two methods of preparation. This is because, in a plant intended for large production volumes, the need to handle an explosive substance in the presence of volatile inflammable substances and to heat such substances to high temperatures represents a not insignificant restriction with regard to safety. Furthermore, toxic vapours can be produced during the removal of the volatile solvent.

Another known method of preparation for adhesively bonding the heat-sensitive substance to the resistive element is in situ polymerization. Patent FR 2 781 878 discloses such a method of preparation. The heat-sensitive substance comprises from 40 to 60% by weight of pulverulent pyrotechnic substance in suspension in 60 to 40% by weight of inert binder capable of curing by polymerization. The heat-sensitive substance is deposited on the resistive element and polymerization is obtained by heating or with radiation. In practice, this method of preparation requires high contents of binder. This therefore limits the proportion of pyrotechnic material in the heat-sensitive substance, increases its dispersion, and, for this reason, reduces the sensitivity of the initiator.

A person skilled in the art is therefore always on the look out for a process for preparing an electropyrotechnic initiator which does not present risks to the safety of the personnel and which makes it possible to deposit on and to adhesively bond to the resistive element a heat-sensitive substance in a way which is reliable and stable over time.

Such a process is a subject-matter of the present invention.

The invention relates to a process for the preparation of an electropyrotechnic initiator comprising a pyrotechnic varnish initiated by a resistive heating element, characterized in that the said pyrotechnic varnish is obtained by deposition, on the resistive element, of an aqueous adhesive composed of a dispersion of an explosive substance and of additives in an aqueous suspension based on a copolymer chosen from ethylene/vinyl acetate copolymers and vinyl acetate/ethylene acetate/ethylene copolymers and then by drying the said aqueous adhesive at a temperature of between 55° C. and 75° C. In the present application, the term "varnish" refers to the solid component obtained by evaporation of the water present in the drop of aqueous adhesive deposited on the initiator. This varnish is also sometimes referred to as "ignition bead".

The invention exhibits the advantage of not employing volatile and inflammable solvents. This is because only water is used. In contrast to the preconceptions indicated in Patent FR 2 781 878, water is easily removed, the drying stage is not lengthy and the performance of the heat-sensitive substance is not damaged.

Another advantage of the invention is to produce a dispersion of the explosive substance in an aqueous suspension based on a copolymer. This makes it possible to render the explosive substance insensitive and to handle it without danger in the liquid state.

The aqueous adhesive is deposited in the liquid state on the resistive element in the form of a calibrated drop using a varnishing device comprising an air-operated metering device. The drop of aqueous adhesive is subsequently dried at a temperature of between 55° C. and 75° C., preferably at 60° C. The fact of heating at a temperature of less than 80° C. makes it possible to avoid the formation of bubbles and thus poor contact with the resistive element.

Drying is carried out according to a drying method standard in industry, such as infrared radiation, pulsed hot air or induction. Infrared radiation is a preferred drying method.

The explosive substance participating in the composition of the aqueous adhesive is chosen from the group consisting of primary explosives and oxidizer-reducer mixtures. According to a first preferred alternative form of the invention, the primary explosive is a dinitrobenzofuroxan salt and better still the primary explosive is potassium dinitrobenzofuroxane. According to a second preferred alternative form of the invention, the explosive substance is a mixture of zirconium and of potassium perchlorate.

This preparation process makes it possible to prepare lead-free aqueous adhesives. This is because the explosive substance participating in the composition can be devoid of lead, which makes it possible to prepare aqueous adhesives which are compatible with the environment.

The content of explosive substance in the pyrotechnic varnish after drying is between 65% and 95% by weight with respect to the total weight of the pyrotechnic varnish.

The water content of the aqueous adhesive before drying is between 55% and 70% by weight with respect to the total weight of the aqueous adhesive. This preparation process thus makes it possible to have, before drying, a high proportion of water, which facilitates the processing, and, after drying, a high proportion of explosive substance, which renders the initiator highly reactive.

According to a preferred alternative form of the invention, the copolymer-based aqueous suspension is obtained by emulsifying ethylene/vinyl acetate or vinyl acetate/ethylene acetate/ethylene copolymer in the presence of surfactant. The preferred surfactants are anionic surfactants and poly(vinyl alcohol). The amount of surfactant used is between 0.1% and 2% by weight with respect to the weight of the copolymer-based aqueous suspension.

According to another preferred alternative form of the invention, the copolymer-based aqueous suspension additionally comprises a plasticizer. This plasticizer is chosen from phthalates. Dibutyl phthalate is a preferred plasticizer. This compound makes it possible to improve the adhesion of the adhesive to the resistive element and to adjust the hardness of the adhesive. The amount of plasticizer is between 0% and 20% by weight with respect to the weight of the copolymer-based aqueous suspension.

Preferably, the copolymer is an ethylene/vinyl acetate copolymer and the proportion of ethylene is between 10 and 30% by weight with respect to the total weight of the ethylene/vinyl acetate copolymer. The amount of copolymer is between 50% and 60% by weight with respect to the total weight of the aqueous suspension based on said copolymer.

According to a preferred alternative form of the invention, the aqueous adhesive additionally comprises additives, such as a thickening agent and an X-ray marker.

The thickening agent is based on modified cellulose; this makes it possible to adjust the viscosity of the adhesive, between 6.5 and 9 Pa.s, to the deposition process. Mention may in particular be made, as thickening agent, of hydroxypropylcellulose, carboxymethylcellulose, methylhydroxypropylcellulose, hydroxyethylcellulose and carboxymethylhydroxyethyl-cellulose. The amount of thickening agent is between 0.5 and 2.5% by weight with respect to the total weight of the aqueous adhesive before drying.

Finally, the adhesive can also comprise an X-ray marker. Its role is to render the adhesive opaque to X-rays in the case where the other constituents of the aqueous adhesive, and in particular the explosive substance, do not comprise heavy metals. The X-ray marker is composed of a metal powder or a metal salt, the said metal having to sufficiently absorb X-rays while being compatible with the environment. It is preferably chosen from the group consisting of tungsten, zirconium, bismuth and silver. This marker thus makes it possible to monitor the initiator during its manufacturing process.

The fundamental novelty of the invention lies in the fact of using an aqueous adhesive comprising an explosive substance and a copolymer in suspension in water. The adhesive is deposited, using a varnishing device comprising an air-operated metering device, in the form of a calibrated drop on the resistive heating element and then the water is evaporated. The evaporation of the water and the nature of the copolymer make it possible to obtain, as shown in the tests carried out, very good adhesion of the adhesive to the resistive element.

The invention also relates to an electro-pyrotechnic initiator prepared according to the process described above comprising a pyrotechnic varnish initiated by a resistive heating element, characterized in that the said pyrotechnic varnish comprises:

from 60 to 95% by weight of explosive substance, from 5 to 15% by weight of surfactant and of ethylene/vinyl acetate or vinyl acetate/ethylene acetate/ethylene copolymer, from 0 to 25% by weight of additives.

The surfactant is chosen from anionic surfactants and poly(vinyl alcohol).

The additives comprise a thickening agent and an X-ray marker. The thickening agent makes it possible to adjust the viscosity of the adhesive; it is based on modified cellulose. The X-ray marker makes it possible to render the pyrotechnic varnish opaque to X-rays. It is a metal powder or a metal salt, the metal being chosen from the group consisting of tungsten, zirconium, bismuth and silver.

The explosive substance is chosen from the group consisting of primary explosives and oxidizer-reducer mixtures. A preferred primary explosive is a dinitrobenzofuroxan salt and better still potassium dinitrobenzofuroxane and a preferred oxidizer-reducer mixture is the mixture of zirconium and of potassium perchlorate.

Such an electropyrotechnic initiator operates with any type of resistive heating element. Preferably, the resistive heating element is a cylindrical filament, a bridge directly photoetched onto a printed circuit support or a bridge, made of thin layers, surface mounted on a printed circuit support.

According to a preferred alternative form of the invention, the explosive substance is a primary explosive and the resistive element is a semiconductor bridge, often denoted by the abbreviation SCB.

A preferred implementation of the invention is described below with reference to FIGS. 1 and 2.

Figure 1:
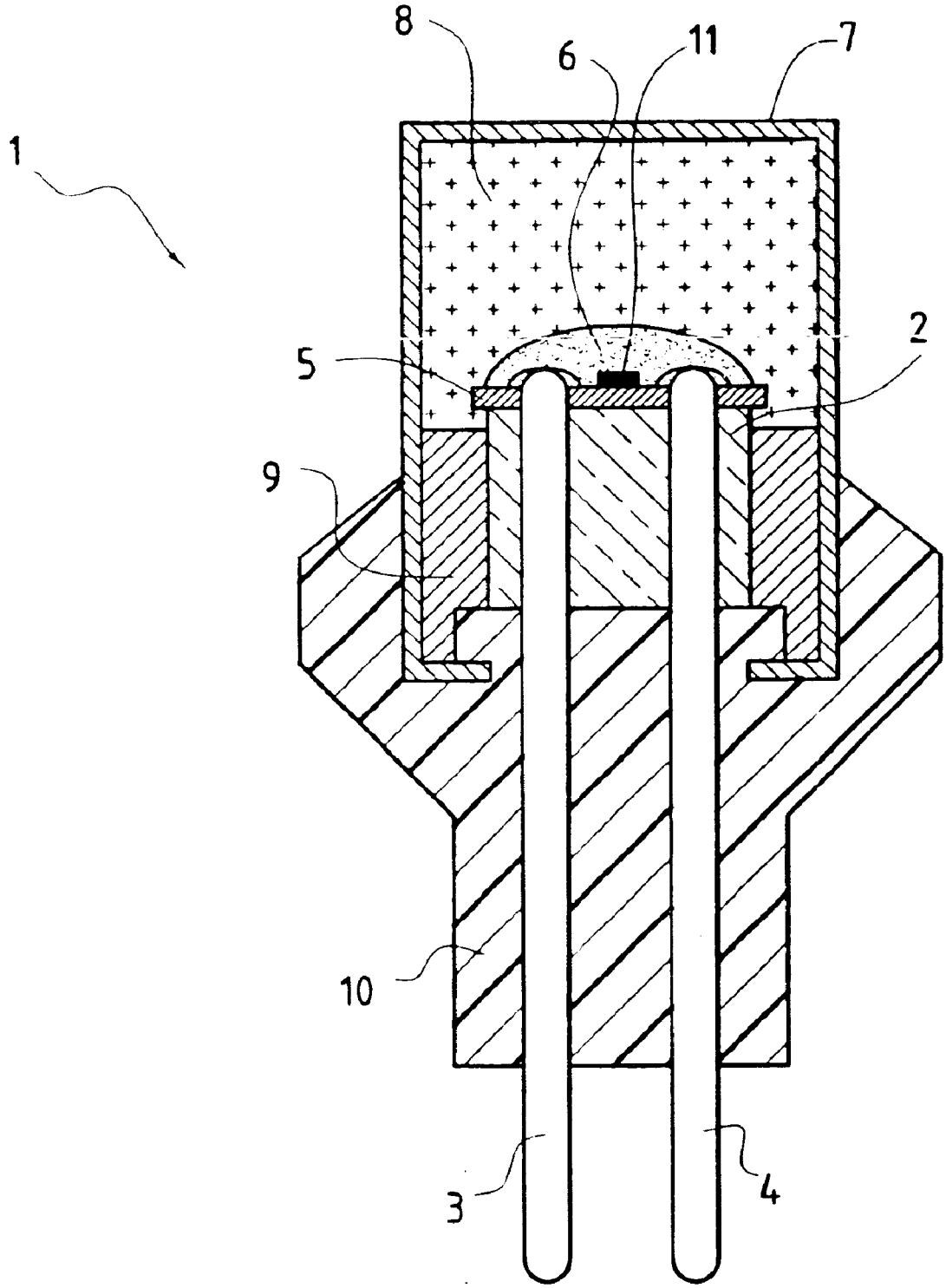
FIG. 1 represents, viewed in cross section, an electropyrotechnic initiator prepared according to the process which is a subject-matter of the invention, in which the resistive element is surface mounted.

With reference more particularly to FIG. 1, it is observed that this electropyrotechnic initiator 1 is prepared from a glass/metal bushing comprising a metal sleeve 9 and an insulating component 2 carrying the two electrodes 3, 4. Each of these two electrodes 3, 4 exhibits, first, an upper end fixed by soldering to a printed circuit 5 comprising a resistive heating element 11 of the SMC ("surface-mounted component") type and, secondly, a lower end intended to be connected to a corresponding tubular socket. The printed circuit 5 is itself attached to the insulating component 2. A pyrotechnic varnish 6 is adhesively bonded to the printed circuit 5 and the resistive element 11 and is surmounted by a metal cap 7 enclosing a reinforcing pyrotechnic composition 8, this metal cap 7 being soldered to the cylindrical metal sleeve 9 of the glass/metal bushing.

An overmoulding 10 of thermoplastic resin partially coats the electrodes 3, 4 and ensures, with the metal cap 7, that the initiator 1 is sealed.

Figure 2:
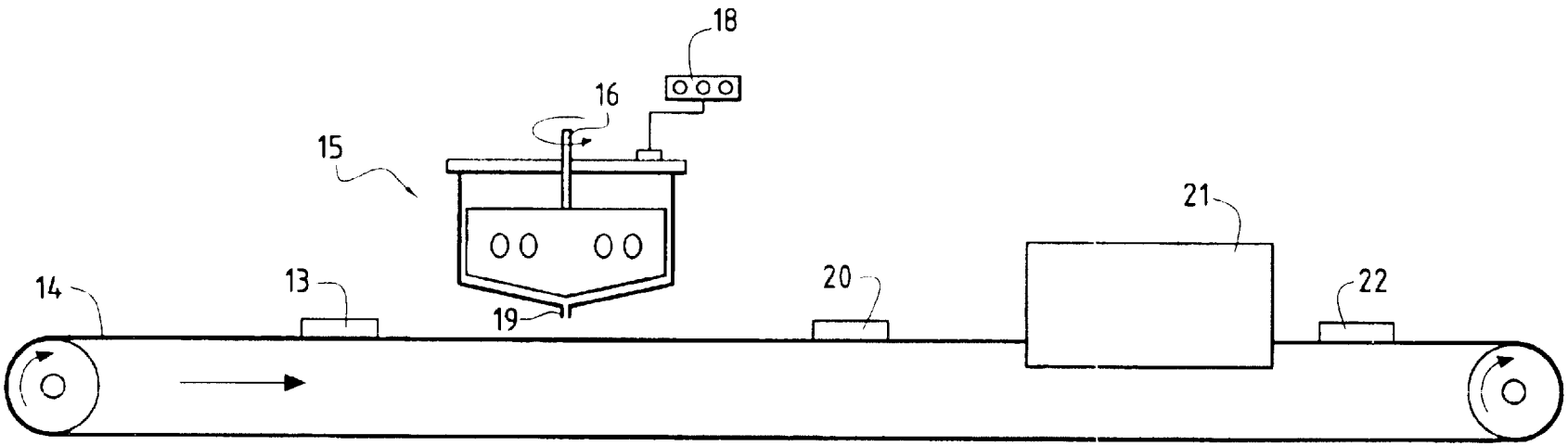
FIG. 2 is a diagram of the device which makes possible the implementation of the process which is a subject-matter of the invention.

With reference to FIG. 2, a preferred method of preparation of the initiator described above is now described.

Electropyrotechnic initiators 1 not yet assembled with the metal cap 7 and the reinforcing pyrotechnic composition 8 are placed in a vehicle 13. This vehicle 13 contains 10 rows of 20 igniters.

The vehicle 13 is placed on a conveyor belt 14. 20 g of aqueous adhesive are placed in a varnishing device 15, represented in cross section. The aqueous adhesive is composed of 2.5% by weight of ethylene/vinyl acetate copolymer and of surfactant, of 29% by weight of potassium dinitrobenzofuroxane, of 8% by weight of tungsten and of 59.5% by weight of water, and 1% by weight of hydroxypropyl cellulose is added to adjust the viscosity to the vicinity of 8 Pa.s. The varnishing device 15 is composed of a rotary stirrer 16. This rotary stirrer 16 is driven with a rotational speed of 35±5 revolutions per minute in order to keep the components of the adhesive in suspension.

A temporary excess pressure over the aqueous adhesive is created in the atmosphere surmounting the adhesive, using an air-operated metering device 18, in order to make possible the formation of drops of aqueous adhesive in the nozzle 19 with a diameter of 0.85 mm.

The vehicle 20 containing the igniters, the resistive element 11 of which is covered with a drop of aqueous adhesive, is subsequently conveyed, via the conveyor belt 14, to an infrared radiation oven 21. The temperature of the oven is 60° C. and the residence time of the igniters in the oven is 30 minutes.

The vehicle 22 containing the dried igniters, that is to say covered with a drop of pyrotechnic varnish 6 with a weight of 9 mg ±3 mg, is subsequently recovered at the outlet of the oven.

After drying, the pyrotechnic varnish is composed of 72% by weight of potassium dinitrobenzofuroxane, of 6% by weight of ethylene/vinyl acetate copolymer and of surfactant, of 2% by weight of hydroxypropyl cellulose and of 20% by weight of tungsten powder.

The examples which follow illustrate the performances of the electropyrotechnic initiators prepared according to the process which is a subject-matter of the invention. To measure these performances, two pyrotechnic varnish compositions, a composition A according to the invention and a composition B according to the state of the art, were tested.

| Composition A: | |
|---|---|
| *Aqueous adhesive according to the invention, before drying: | |
| potassium dinitrobenzofuroxane | 29.0 ± 1.0% |
| water | 59.5 ± 1.0% |
| ethylene/vinyl acetate copolymer (EVA) + poly(vinyl alcohol) | 2.5 ± 0.2% |
| hydroxypropyl cellulose | 1.0 ± 0.05% |
| tungsten powder | 8.0 ± 1.0% |
| *Pyrotechnic varnish according to the invention, after drying: | |
| potassium dinitrobenzofuroxane | 72.0 ± 1.0% |
| ethylene/vinyl acetate copolymer (EVA) + poly(vinyl alcohol) | 6.0 ± 0.5% |
| hydroxypropyl cellulose | 2.0 ± 0.05% |
| tungsten powder | 20.0 ± 1.0% |

The aqueous suspension of ethylene/vinyl acetate copolymer is sold by Labord SA under the name 239M.

| Composition B: | |
|---|---|
| *Adhesive, with solvent, according to the state of the art (Patent FR 2 704 944 and its corresponding U.S. 5 544 585), before drying | |
| ultrafine neutral lead trinitroresorcinate | 59.1 ± 1.0% |
| vinyl acetate/vinyl chloride copolymer | 5.8 ± 0.5% |
| methyl ethyl ketone | 19.8 ± 1.0% |
| butyl acetate | 14.9 ± 1.0% |
| dibutyltin dilaurate (stabilizer) | 0.4 ± 0.05% |
| *Pyrotechnic varnish according to the state of the art, after drying: | |
| ultrafine neutral lead trinitroresorcinate | 90.5 ± 1.0% |
| vinyl acetate/vinyl chloride copolymer | 8.9 ± 0.5% |
| dibutyltin dilaurate (stabilizer) | 0.6 ± 0.05% |

EXAMPLE 1

Adhesion of the Pyrotechnic Varnish to the Resistive Element

Two types of tests make it possible to quantify the adhesion of the pyrotechnic varnish to the resistive element. The electropyrotechnic initiator described above is used in carrying out these two tests.

The first test consists in subjecting the initiator to an acceleration of greater than 20 000 g, i.e. greater than 196 000 m/s$^2$, in the positive direction of the axis of the initiator perpendicular to the plane of adhesive bonding of the pyrotechnic varnish.

This test is repeated on the same initiator until separation of the pyrotechnic varnish from the resistive element to which it is adhesively bonded is demonstrated.

A second test consists in testing the adhesion to a metal support of an inactive pyrotechnic varnish, that is to say in which the explosive substance has been replaced, for reasons of safety, by an inert substance. To do this, two test specimens are adhesively bonded with this inactive pyrotechnic varnish, a tensile test is carried out on these two test specimens and the maximum stress which the pyrotechnic varnish can withstand is measured.

Example 1

| | 1st test: percentages of items which become detached | 2nd test: maximum stress measured to obtain detachment of the 2 test specimens |
|---|---|---|
| Composition A (or composition A modified for the 2nd test) | 10% of the items become detached after 7 tests | 9.3 N/cm$^2$ |
| Composition B (or composition B modified for the 2nd test) | 40% of the items become detached after only 1 test | 1.1 N/cm$^2$ |

The first test shows that the igniters comprising an initiator prepared according to the process which is a subject-matter of the invention can withstand 20 000 g of acceleration up to 6 times, that is to say an acceleration of 196 000 $M/s^2$ up to 6 times.

The pyrotechnic varnish according to the invention (composition A) thus exhibits better adhesion to the resistive element. In the context of the second test, it is seen that the maximum stress measured to obtain detachment of the two test specimens adhesively bonded by the ignition bead of composition A, that is to say according to the invention, is 8.5 times greater than that measured to obtain detachment of the two test specimens adhesively bonded by the ignition bead of composition B, that is to say according to the state of the art.

EXAMPLE 2

Performance of an Initiator Prepared According to the Process Which is a Subject-Matter of the Invention The electropyrotechnic initiator described above is used in carrying out this performance test.

This test consists in conditioning the initiator at −40° C. for 2 hours, and then placing it in a manometric bomb and subjecting it to an electrical impulse with an amplitude of 1.2 A for 2 ms. The pressure generated by the initiator inside the bomb is then measured. The term "time for appearance of pressure" is used to denote the time necessary for a pressure of $0.2\times10^5$ Pa, i.e. 0.2 bar, to be generated inside the manometric bomb.

Time t0 is taken as being the moment when the electrical impulse is despatched.

Example 2

| | Time for appearance of pressure |
|---|---|
| Initiator in which the resistive element is covered with the composition A | 0.3 ms–0.4 ms |
| Initiator in which the resistive element is covered with the composition B | 0.6 ms–1 ms |

The initiators in which the resistive element is covered with the pyrotechnic varnish according to the invention (composition A) give shorter and more reproducible operating times than the initiators according to the state of the art (composition B).

EXAMPLE 3

Ability of the Pyrotechnic Varnish to Initiate the Reinforcing Charge of the Electropyrotechnic Initiator The electropyrotechnic initiator described above is used in carrying out this test. The reinforcing charge is separated physically from the body of the initiator.

To this end, on the one hand, the initiator comprising only the resistive element covered with the pyrotechnic varnish and, on the other hand, the reinforcing charge are placed in a manometric bomb. These two components are placed at a calibrated distance from one another. The initiator is subjected, at ambient temperature, to an electrical impulse with an amplitude of 1.2 A for 2 ms. The pressure curve is recorded and the times corresponding to the first rise in pressure and to the second rise in pressure, starting from the time t0 corresponding to the beginning of the electrical impulse, are measured. The time Δt which passes between the two rises in pressure ($\Delta t=t_2-t_1$) is subsequently calculated.

The first rise in pressure is due to the combustion of the pyrotechnic varnish and the second rise in pressure is due to the combustion of the reinforcing charge.

This test is carried out on fresh initiators and on aged initiators (accelerated ageing for 400 hours at 107° C.).

Example 3

| | Time Δt in the case of fresh initiators | Time Δt in the case of aged initiators |
|---|---|---|
| Composition A | 0.79 ms | 0.88 ms |
| Composition B | 1.02 ms | 3.88 ms |

This test therefore shows that the pyrotechnic varnish which is a subject-matter of the invention has a better ability to ignite the reinforcing charge of the initiator than a pyrotechnic varnish according to the state of the art, this being all the more noticeable with aged initiators.

What is claimed is:

1. Process for the preparation of an electropyrotechnic initiator comprising a pyrotechnic varnish in contact with a resistive heating element, comprising:

preparing an aqueous adhesive composed of a dispersion of an explosive substance and of additives in an aqueous suspension based on a copolymer chosen from ethylene/vinyl acetate copolymers and vinyl acetate/ethylene acetate/ethylene copolymers;

depositing said aqueous adhesive on the resistive element; and drying the said aqueous adhesive at a temperature of between 55° C. and 75° C. in order to remove the water contained in the adhesive and to obtain the varnish.

2. Process according to claim 1, characterized in that the drying of the aqueous adhesive is carried out by infrared radiation.

3. Process according to claim 1, characterized in that the aqueous adhesive is deposited in the liquid state on the resistive element in the form of a calibrated drop using a varnishing device comprising an air-operated metering device.

4. Process according to claim 1, characterized in that the explosive substance is chosen from the group consisting of primary explosives and oxidizer-reducer mixtures.

5. Process according to claim 4, characterized in that the primary explosive is a dinitrobenzofuroxan salt.

6. Process according to claim 5, characterized in that the primary explosive is potassium dinitrobenzofuroxane.

7. Process according to claim 4, characterized in that the explosive substances is a mixture of zirconium and of potassium perchlorate.

8. Process according to claim 1, characterized in that the water content of the aqueous adhesive before drying is between 55 and 70% by weight with respect to the weight of the aqueous adhesive.

9. Process according to claim 1, characterized in that the content of explosive substance in the pyrotechnic varnish after drying is between 65 and 95% by weight with respect to the total weight of the pyrotechnic varnish.

10. Process according to claim 1, characterized in that the amount of copolymer is between 50 and 60% by weight with respect to the total weight of the aqueous suspension based on said copolymer.

11. Process according to claim 1, characterized in that the copolymer-based aqueous suspension additionally comprises a surfactant chosen from the group consisting of anionic surfactants and poly(vinyl alcohol).

12. Process according to claim 1, characterized in that the copolymer-based aqueous suspension additionally comprises a plasticizer chosen from phthalates.

13. Process according to claim 1, characterized in that the aqueous adhesive additionally comprises a thickening agent based on modified cellulose.

14. Process according to claim 1, characterized in that the aqueous adhesive additionally comprises a metal powder or a metal salt which is opaque to X-rays.

15. Process according to claim 14, characterized in that the metal is chosen from the group consisting of tungsten, zirconium, bismuth and silver.

16. Electropyrotechnic initiator prepared according to claim 1 comprising a pyrotechnic varnish initiated by a resistive heating element, characterized in that the pyrotechnic varnish comprises:

from 60 to 95% by weight of explosive substance, from 5 to 15% by weight of surfactant and of ethylene/vinyl acetate or vinyl acetate/ethylene acetate/ethylene copolymer, from 0 to 25% by weight of additives.

17. Electropyrotechnic initiator according to claim 16, characterized in that the additives comprise a thickening agent and an X-ray marker.

18. Electropyrotechnic initiator according to claim 17, characterized in that the thickening agent is based on modified cellulose.

19. Electropyrotechnic initiator according to claim 17, characterized in that the X-ray marker is a metal powder or a metal salt, the metal being chosen from the group consisting of tungsten, zirconium, bismuth and silver.

20. Electropyrotechnic initiator according to claim 16, characterized in that the explosive substance is chosen from the group consisting of primary explosives and oxidizer-reducer mixtures.

21. Electropyrotechnic initiator according to claim 20, characterized in that the resistive heating element is a cylindrical filament.

22. Electropyrotechnic initiator according to claim 20, characterized in that the resistive heating element is a bridge directly photoetched onto a printed circuit support.

23. Electropyrotechnic initiator according to claim 20, characterized in that the resistive heating element is a bridge, made of thin layers, which is surface mounted on a printed circuit support.

24. Electropyrotechnic initiator according to claim 20, characterized in that the explosive substances is a primary explosive.

25. Electropyrotechnic initiator according to claim 24, characterized in that the resistive heating element is a semiconductor bridge referred to as SCB.

* * * * *